US007185840B2

(12) United States Patent
Kuwabara et al.

(10) Patent No.: US 7,185,840 B2
(45) Date of Patent: Mar. 6, 2007

(54) WEB WINDING APPARATUS

(75) Inventors: Fujio Kuwabara, Minamiashigara (JP); Hironori Sasaki, Minamiashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 279 days.

(21) Appl. No.: 10/999,966

(22) Filed: Dec. 1, 2004

(65) Prior Publication Data

US 2005/0139716 A1 Jun. 30, 2005

(30) Foreign Application Priority Data

Dec. 3, 2003 (JP) ..... 2003-404645

(51) Int. Cl.
*B65H 18/08* (2006.01)

(52) U.S. Cl. ..... 242/530.3

(58) Field of Classification Search ..... 242/530.1, 242/530.3, 530.4; 403/13
See application file for complete search history.

(56) References Cited

U.S. PATENT DOCUMENTS 3,322,361 A * 5/1967 Young ..... 242/530.3
3,547,332 A * 12/1970 Gaudin ..... 226/195
4,026,488 A * 5/1977 Hashimoto ..... 242/571.2
4,693,431 A * 9/1987 Kataoka ..... 242/413.1
6,079,662 A * 6/2000 Miller et al. ..... 242/571.2
2002/0121570 A1* 9/2002 Yermal ..... 242/530.3

FOREIGN PATENT DOCUMENTS

JP 2000-16642 A 1/2000

* cited by examiner

*Primary Examiner*—William A. Rivera
*Assistant Examiner*—Sang Kim
(74) *Attorney, Agent, or Firm*—Sughrue Mion, PLLC

(57) ABSTRACT

A plurality of collars are mounted on a takeup shaft for axially pressing and holding a plurality of spools which are mounted on the takeup shaft. The takeup shaft includes an axial thrust groove defined therein. The collars include respective rolling bearings inserted in the thrust groove for preventing the collars from rotating with respect to the takeup shaft. The rolling bearings are rotatably movable in and along the thrust groove.

6 Claims, 7 Drawing Sheets

WEB WINDING APPARATUS

BACKGROUND OF THE INVENTION

1. Field of the Invention

The present invention relates to a web winding apparatus including a plurality of spools rotatably disposed in an axial array on a takeup shaft, which can be rotated to wind up webs on the respective spools.

2. Description of the Related Art

There are known rewinders for automatically winding an elongate web such as an elongate film, an elongate sheet of light shielding paper, or the like on a spool, and slitters for slitting, i.e. longitudinally cutting a wide stock web into elongate webs each having a predetermined width and automatically winding the webs on respective spools. Those rewinders and slitters incorporate a web winding apparatus having a plurality of spools that are rotatable to wind respective elongate webs therearound.

One web winding apparatus of the type described above has a sheet takeup shaft assembly as disclosed in Japanese Laid-Open Patent Publication No. 2000-16642, for example. As shown in FIG. 7 of the accompanying drawings, the disclosed sheet takeup shaft assembly has a plurality of spool holders 2 disposed in an axial array on a shaft 1 which supports spacers 3 on respective opposite ends thereof. The spool holders 2 are fixedly held on the shaft 1 by a nut 4 which is threaded into one end of the shaft 1. Each of the spool holders 2 has a fixed member 5 and a movable member 6 slidably fitted over the fixed member 5. A piston 7 is movably mounted in the fixed member 5, providing a cylinder 8.

The shaft 1 has an air supply passage 9 defined centrally therein which is held in communication with an air inlet path 10 defined axially in an outer circumferential surface of the shaft 1. The cylinders 8 of the respective spool holders 2 communicate with the air inlet path 10.

Spools 11 are disposed in the respective spool holders 2. When air under pressure is supplied from the air supply passage 9, the air under pressure flows from the air inlet path 10 into the cylinders 8 of the respective spool holders 2. The pressure buildup in the cylinders 8 displaces the pistons 7 into abutment against the movable members 6, which move toward one end of each spool 11. The spools 11 are now held in position by the movable members 6 and the fixed members 5 that are positioned on the other ends of the spools 11.

Then, the leading ends of elongate webs (not shown) are attached to the respective outer circumferential surfaces of the spools 11. When the spools 11 are rotated, the spool holders 2 are also rotated in unison with the spools 11. The spools 11 are sandwiched between the vertical surfaces of the fixed members 5 and the movable members 6. Slippage occurs on the opposite ends of the spools 11 due to the resistance posed by the webs against the rotation of the spools 11, and the webs are wound on the spools 11 under tension.

Since the spools 11 are axially arrayed on the shaft 1, the webs can be wound on the respective spools 11 under constant tension without causing an error with respect to the dimension of wound layers of the webs.

However, in the conventional sheet takeup shaft assembly, the plural spool holders 2 are mounted on the shaft 1 and incorporate the respective cylinders 8 which have the pistons 7 for moving the movable members 6 toward and away from the respective fixed members 5. Therefore, the spool holders 2 are considerably complex in structure, making the overall sheet takeup shaft assembly including the spool holders 2 highly costly to manufacture and hence uneconomical.

SUMMARY OF THE INVENTION

It is a major object of the present invention to provide a web winding apparatus which is of a relatively simple and compact structure and which is capable of winding webs smoothly and highly accurately on a plurality of respective spools.

According to the present invention, a web winding apparatus comprises a plurality of spools rotatably disposed in an axial array on a takeup shaft and a plurality of spool holders mounted on the takeup shaft for axially pressing and holding the spools. The spool holders include respective rotors inserted in a thrust groove of the takeup shaft for preventing the spool holders from rotating with respect to the takeup shaft, the rotors being rotatably movable in and along the thrust groove.

Preferably, the spool holders comprise respective collars mounted on the takeup shaft alternately with the spools, and the rotors comprise respective rolling bearings mounted on respective inner circumferential surfaces of the collars and including at least respective portions projecting into the thrust groove.

Preferably, the web winding apparatus includes a fixed collar mounted on an end of the takeup shaft, and a pressing mechanism mounted on an opposite end of the takeup shaft for applying a thrust load to the spools and the spool holders toward the fixed collar.

According to the present invention, the spool holders with the rotors inserted in the thrust groove are rotatable in unison with the takeup shaft, and are axially movable along the thrust groove upon rotation of the rotors in the thrust groove. Therefore, the frictional resistance between the rotors and the inner wall surfaces of the thrust groove is effectively reduced, allowing all the spool holders to move axially smoothly and reliably along the takeup shaft. Therefore, it is possible to pose desired rotational resistance, i.e., a desired winding torque, to all the spools. Webs can thus reliably be wound on the respective spools disposed on the takeup shaft, and are prevented from loosening up after being wound on the spools and suffering displaced edges while being wound on the spools.

The takeup shafts and parts associated therewith are effectively simplified in structure as only the rotors need to be mounted on the respective spool holders. The web winding apparatus is thus simple and compact in overall structure, and is economical.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
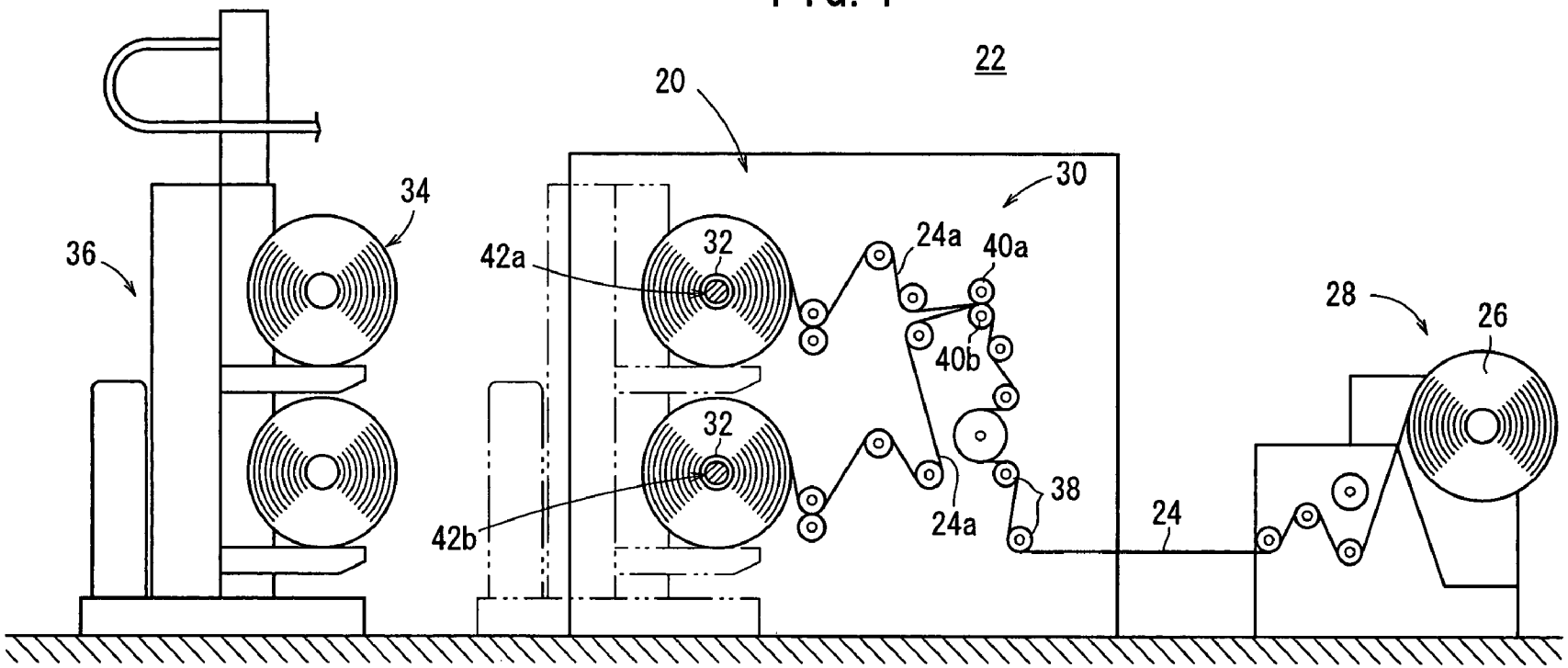
FIG. 1 is a schematic view of a web processing system incorporating a web winding apparatus according to an embodiment of the present invention.

FIG. 1 schematically shows a web processing system 22 incorporating a web winding apparatus 20 according to an embodiment of the present invention.

As shown in FIG. 1, the web processing system 22 includes: a web unwinding apparatus 28 for rotating a rolled stock web 24 in the form of a web roll 26 to unwind the rolled stock web 24; a slitting apparatus 30 for slitting, i.e., longitudinally cutting the stock web 24 into a plurality of elongate webs 24*a* each having a predetermined width; a web winding apparatus 20 for winding the elongate webs 24*a* on respective spools 32 and then transversely cutting off the elongate webs 24*a* to a predetermined length, producing web products 34; and a product unloading machine 36 for unloading the web products 34 from the web winding apparatus 20.

The slitting apparatus 30 has a plurality of feed rollers 38 for feeding the stock web 24, and a plurality of sets of cutters, e.g., rotary cutters, 40*a*, 40*b* for slitting the stock web 24 into a plurality of elongate webs 24*a*. The elongate webs 24*a* are sorted into upper and lower groups, and delivered to takeup shafts 42*a*, 42*b* of the web winding apparatus 20.

Figure 2:
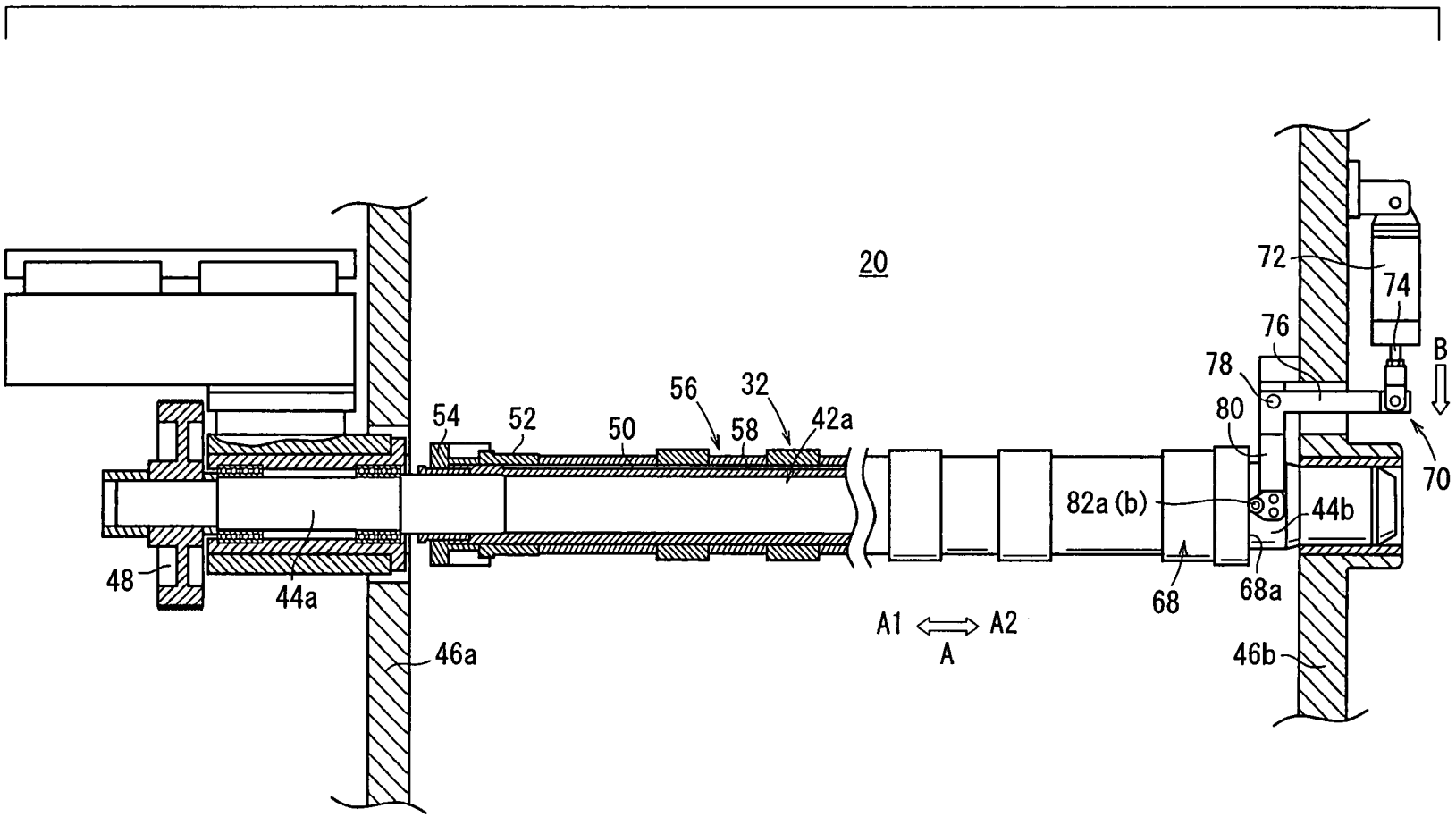
FIG. 2 is a fragmentary view, partly in cross section, of the web winding apparatus.

As shown in FIG. 2, the takeup shaft 42*a* has opposite ends 44*a*, 44*b* rotatably supported on respective support plates 46*a*, 46*b*. A drive pulley 48 is fixedly mounted on the end 44*a*. The drive pulley 48 is rotated about its own axis by drive forces transmitted from a drive unit (not shown).

The takeup shaft 42*a* has a thrust groove 50 defined in an outer circumferential surface thereof and extending axially as indicated by the arrow A. A fixed collar 52 is fitted over the takeup shaft 42*a* near the end 44*a* thereof. The fixed collar 52 is engaged by a stopper 54 that is fitted over the takeup shaft 42*a* immovably in the direction indicated by the arrow A1 with respect to the end 44*a* of the takeup shaft 42*a*. A plurality of spools 32 and a plurality of collars 56 serving as spool holders are axially alternately mounted on the takeup shaft 42*a*.

Figure 3:
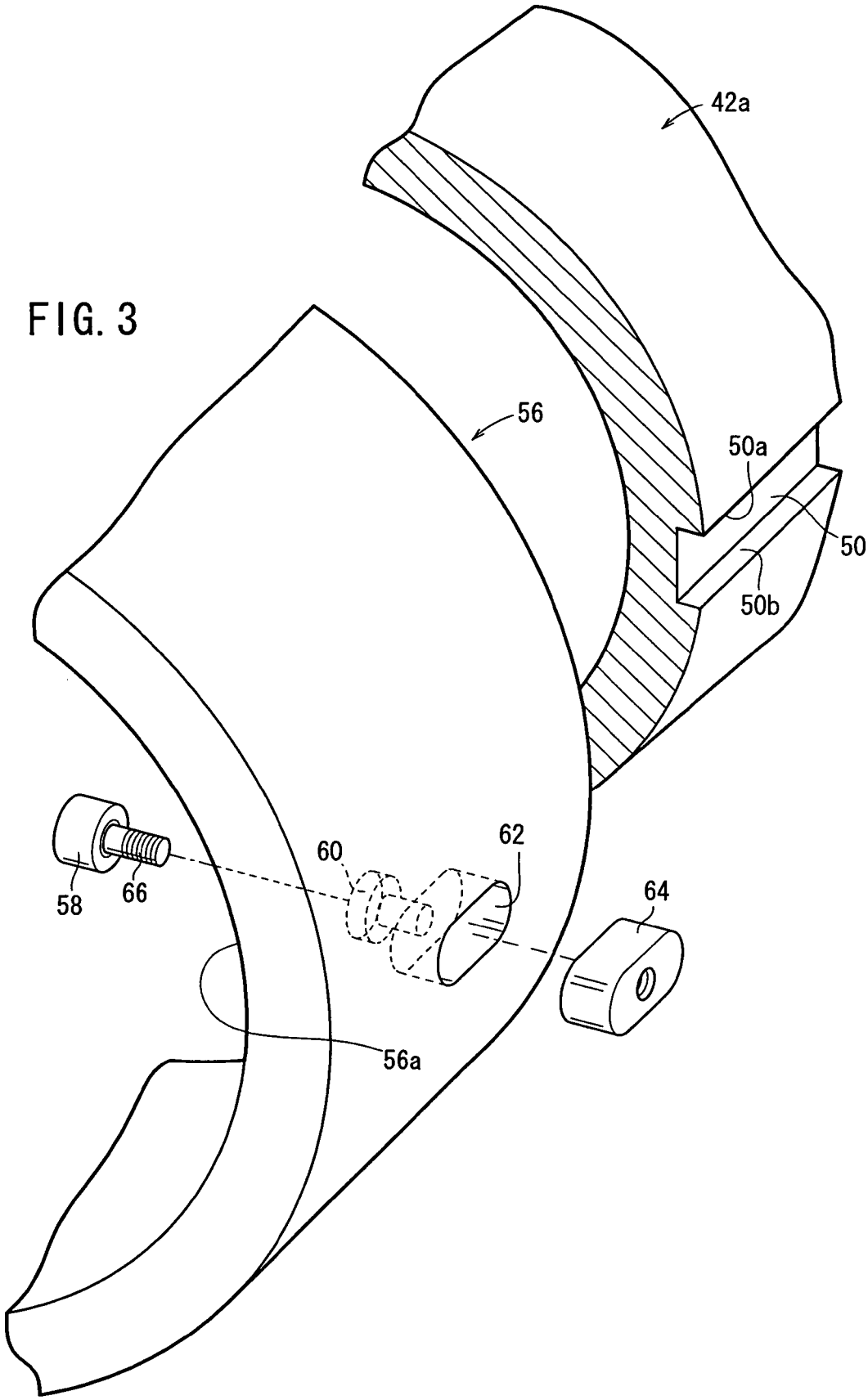
FIG. 3 is an enlarged fragmentary perspective view of a collar of the web winding apparatus with a rolling bearing.

As shown in FIG. 3, each of the collars 56 is of a ring shape and has a recess 60 defined in an inner circumferential surface 56*a* thereof and mounting therein a rotor such as a rolling bearing 58, for example. The recess 60 communicates radially with a recess 62 defined in an outer circumferential surface of the collar 56. A key-shaped nut 64 is disposed in the recess 62. The rolling bearing 58 has a shaft 66 projecting from one end thereof and including an externally threaded portion threaded into the key-shaped nut 64, and hence is rotatably mounted on the collar 56.

Figure 4:
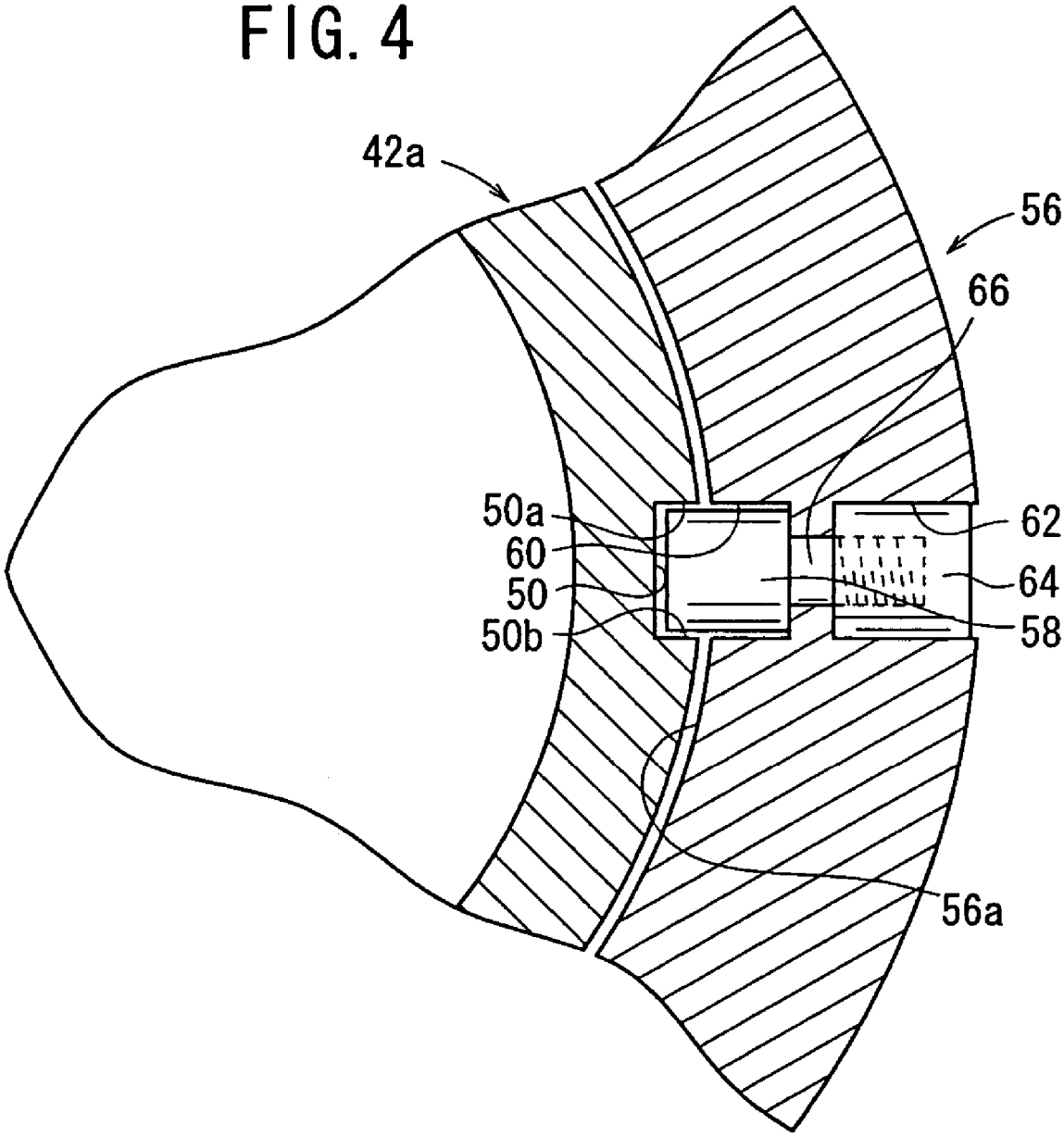
FIG. 4 is an enlarged fragmentary cross-sectional view of the collar.

As shown in FIG. 4, the rolling bearing 58 has an end remote from the shaft 66 and having at least a portion projecting from the inner circumferential surface 56*a* of the collar 56. The projecting portion of the end of the rolling bearing 58 is inserted in the thrust groove 50 in the takeup shaft 42*a*. The rolling bearing 58 has a diameter smaller than the distance between opposite inner wall surfaces 50*a*, 50*b* of the thrust groove 50, and is rotatable in sliding contact with the inner wall surface 50*a* or 50*b*.

As shown in FIG. 2, a movable collar 68 is fitted over the other end 44*b* of the takeup shaft 42*a*. The movable collar 68 is engaged by a pressing mechanism 70 for applying a thrust load to the spools 32 and the collars 56 toward the fixed collar 52 in the direction indicated by the arrow A1. The movable collar 68 and the fixed collar 52 are identical in structure to the collars 56.

Figure 5:
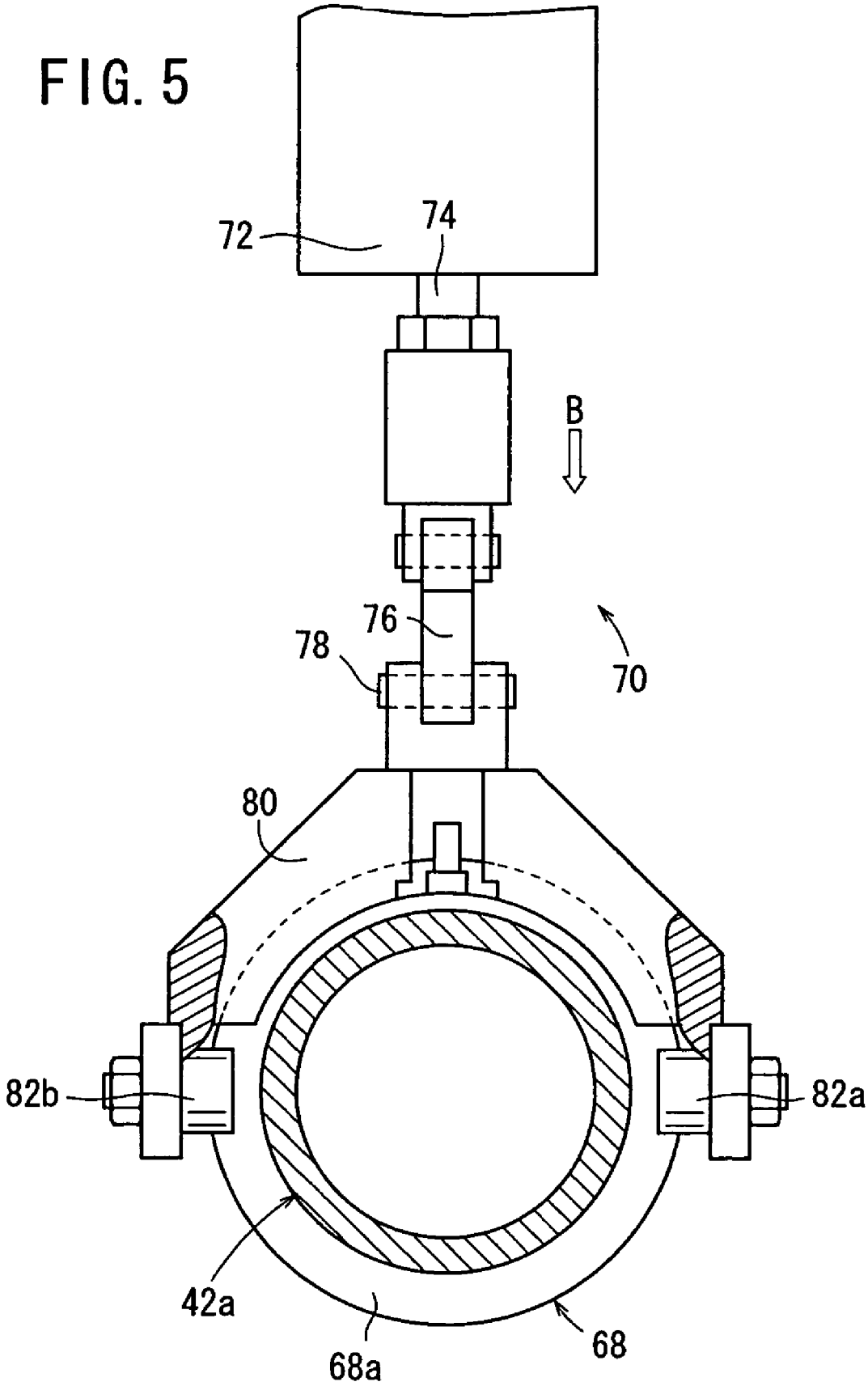
FIG. 5 is a front elevational view of a pressing mechanism of the web winding apparatus.

As shown in FIGS. 2 and 5, the pressing mechanism 70 has a cylinder 72 swingably mounted on the support plate 46*b* and a rod 74 extending from the cylinder 72. A swing arm 76 has an end coupled to the rod 74. The swing arm 76 is substantially L-shaped and has a central bent corner pivotally supported on the support plate 46*b* by a pivot shaft 78.

On the other end of the swing arm 76, there is fixedly mounted a substantially arch-shaped attachment arm 80 extending in straddling relation to the takeup shaft 42*a*. Rollers 82*a*, 82*b* are rotatably mounted on respective opposite free ends of the attachment arm 80 for rolling contact with a larger-diameter end face 68*a* of the movable collar 68.

The takeup shaft 42*b* and parts associated therewith are constructed in the same manner as the takeup shaft 42*a* and parts associated therewith which have been described above.

Operation of the web processing system 22 thus constructed will be described below in relation to the web winding apparatus 20 according to the embodiment of the present invention.

As shown in FIG. 1, the web roll 26 installed in the web unwinding apparatus 28 is unwound by an unwinding motor (not shown), delivering the stock web 24 to the slitting apparatus 30. In the slitting apparatus 30, the cutters 40*a*, 40*b* slit the stock web 24 into a plurality of elongate webs 24*a* each having a predetermined width. The elongate webs 24*a* are then fed to the web winding apparatus 20.

In the web winding apparatus 20, the elongate webs 24*a* are sorted into upper and lower groups, and delivered to the takeup shafts 42*a*, 42*b*. Since the takeup shafts 42*a*, 42*b* operate in the same manner as each other, only operation of the takeup shaft 42*a* will be described below.

Over the takeup shaft 42*a*, the spools 32 and the collars 56 are alternately fitted for winding up the respective webs 24*a* that are sorted and delivered to the takeup shaft 42*a* (see FIG. 2). When the cylinder 72 of the pressing mechanism 70 is actuated, the rod 74 is pushed downwardly in the direction indicated by the arrow B. The swing arm 76 coupled to the rod 74 is angularly moved about the pivot shaft 78, causing the rollers 82*a*, 82*b* on the attachment arm 80 to press the end face 68*a* of the movable collar 68 in the direction indicated by the arrow A1.

Therefore, a thrust load is applied to the spools 32 and the collars 56 toward the fixed collar 52 in the direction indicated by the arrow A1, pressing and holding the end faces of the spools 32 against the collars 56. The webs 24*a* have respective leading ends attached in advance to the respective spools 32.

When the drive pulley 48 is rotated about its own axis by the drive forces transmitted from the drive unit (not shown), the takeup shaft 42*a* connected to the drive pulley 48 is rotated about its own axis. The collars 56 are fitted over the takeup shaft 42*a* for individual movement only in the thrust direction indicated by the arrow A through the engagement of the rolling bearings 58 in the thrust groove 50.

Therefore, when the takeup shaft 42*a* is rotated about its own axis, the collars 56 are rotated in unison with the takeup shaft 42*a*, and the spools 32 held by the collars 56 are rotated under a predetermined torque due to the pressed engagement with the collars 56. The webs 24*a* are thus wound up on the respective spools 32 under desired winding tension.

According to the present embodiment, the spools 32 are rotatably mounted on the takeup shaft 42*a*, and the collars 56 for axially pressing and holding the spools 32 are mounted on the takeup shaft 42*a*. The collars 56 have the respective rolling bearings 58 inserted in the thrust groove 50 defined axially in the takeup shaft 42*a* for preventing the collars 56 from rotating with respect to the takeup shaft 42*a*, the rolling bearings 58 being rotatably movable in and along the thrust groove 50.

Consequently, the collars 56 with the rolling bearings 58 inserted in the thrust groove 50 are rotatable in unison with the takeup shaft 42*a*, and are axially movable along the thrust groove 50 upon rotation of the rolling bearings 58 in the thrust groove 50. The frictional resistance between the rolling bearings 58 and the inner wall surfaces 50*a*, 50*b* of the thrust groove 50 is effectively reduced, allowing all the collars 56 to move axially smoothly and reliably along the takeup shaft 42*a*.

Therefore, it is possible to pose desired rotational resistance, i.e., a desired winding torque, to all the spools 32. The webs 24*a* can thus reliably be wound on the respective spools 32 disposed on the takeup shaft 42*a*, and are prevented from loosening up after being wound on the spools 32 and suffering displaced edges while being wound on the spools 32.

Figure 6:
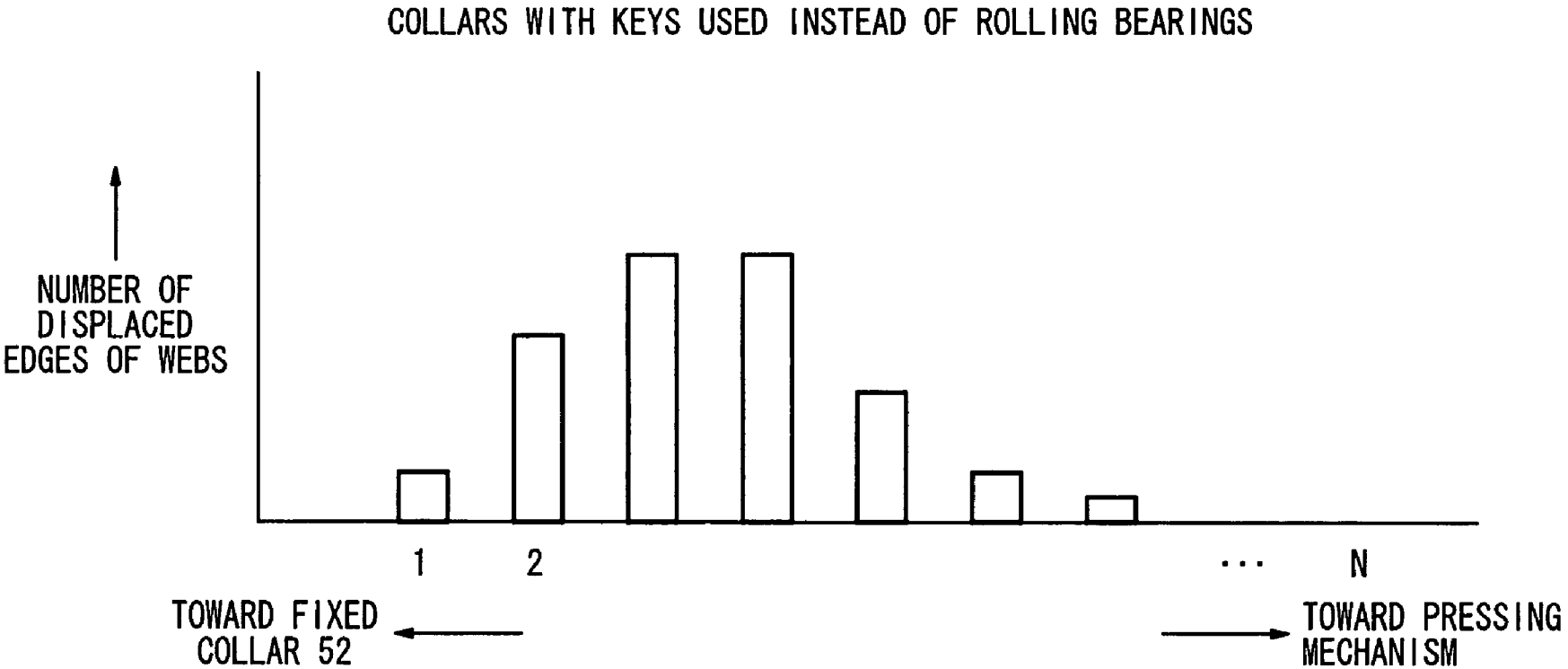
FIG. 6 is a diagram showing the number of displaced edges of webs wound on spools using general keys instead of rolling bearings.
Figure 7:
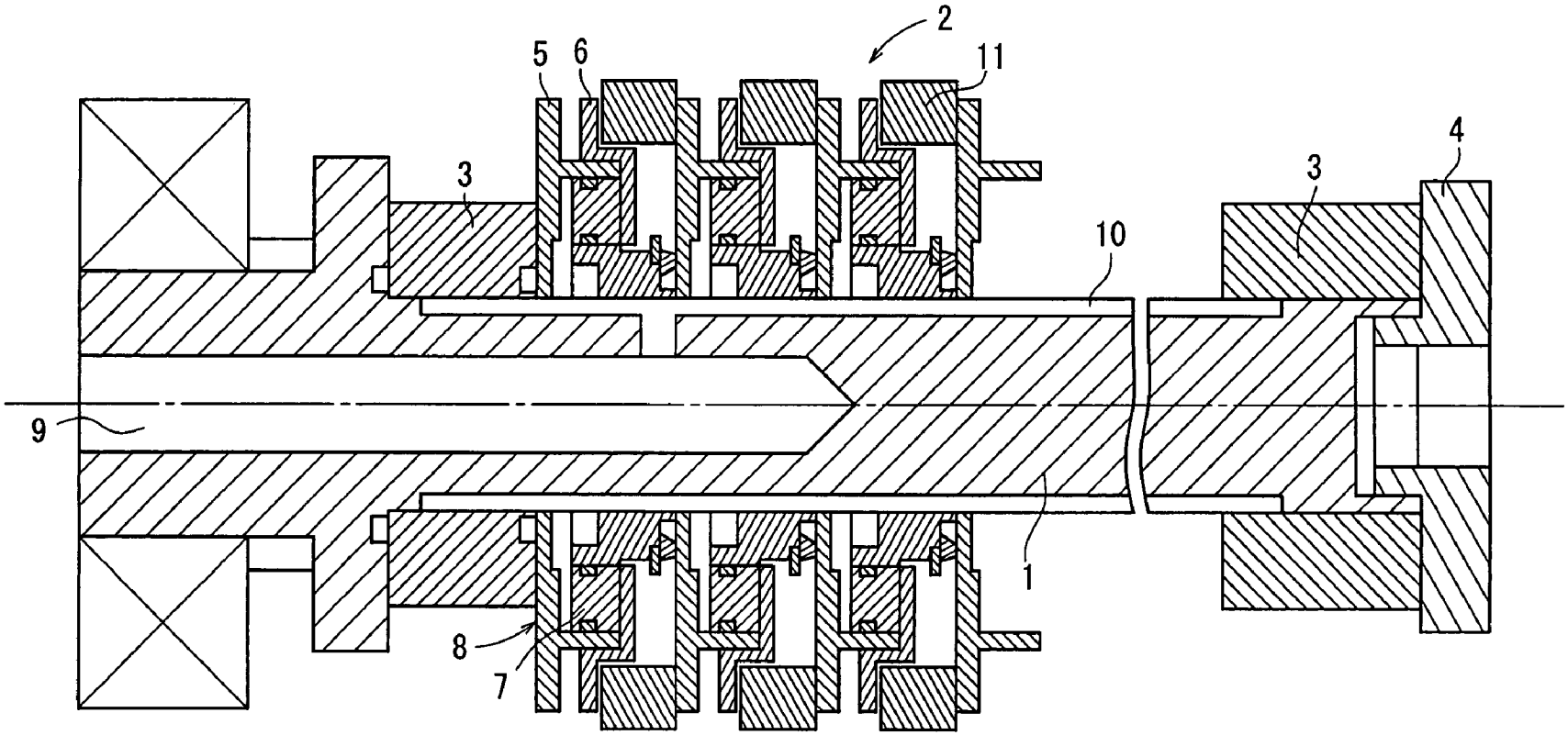
FIG. 7 PRIOR ART
FIG. 7 is a cross-sectional view of a conventional sheet takeup shaft assembly.

General keys (not shown) were mounted instead of the rolling bearings 58 on the inner circumferential surfaces of the respective collars 56, and the webs 24*a* were wound on the respective spools 32. As a result, as shown in FIG. 6, those webs 24*a* wound on the respective spools 32 near the fixed collar 52 suffered many displaced edges, and acceptable products 34 could not efficiently be produced.

According to the present embodiment which employs the rolling bearings 58, acceptable products 34 were efficiently produced without causing displaced edges on the webs 24*a* wound on all the spools 32.

According to the present embodiment, the takeup shafts 42*a*, 42*b* and parts associated therewith are effectively simplified in structure as only the rolling bearings 58 need to be mounted on the respective collars 56. The web winding apparatus 20 is thus simple and compact in overall structure, and is economical.

As shown in FIG. 1, after the webs 24*a* are wound on the respective spools 32, the webs 24*a* are cut off into products 34. The products 34*a* are then unloaded from the web winding apparatus 20 and delivered to the product unloading machine 36.

Although a certain preferred embodiment of the present invention has been shown and described in detail, it should be understood that various changes and modifications may be made therein without departing from the scope of the appended claims.

What is claimed is:

1. A web winding apparatus comprising:

a takeup shaft rotatable about its own axis and including a thrust groove defined axially therein;

a plurality of spools rotatably disposed in an axial array on said takeup shaft, said takeup shaft being rotatable to wind up webs respectively on said spools; and a plurality of spool holders mounted on said takeup shaft for axially pressing and holding said spools;

said spool holders including respective rotors inserted in said thrust groove of said takeup shaft for preventing said spool holders from rotating with respect to said takeup shaft, said rotors being rotatably movable in and along said thrust groove.

2. A web winding apparatus according to claim 1, wherein said spool holders comprise respective collars mounted on said takeup shaft alternately with said spools, and said rotors comprise respective rolling bearings mounted on respective inner circumferential surfaces of said collars and including at least respective portions projecting into said thrust groove.

3. A web winding apparatus according to claim 2, wherein said collars include respective recesses defined in outer circumferential surfaces thereof, and key-shaped nuts are disposed respectively in said recesses, said rolling bearings including respective externally threaded portions threaded into said key-shaped nuts, respectively.

4. A web winding apparatus according to claim 2, wherein each of said rolling bearings includes a diameter smaller than the distance between opposite inner wall surfaces of said thrust groove.

5. A web winding apparatus according to claim 1, further comprising:

a fixed collar mounted on an end of said takeup shaft; and a pressing mechanism mounted on an opposite end of said takeup shaft for applying a thrust load to said spools and said spool holders toward said fixed collar.

6. A web winding apparatus according to claim 5, wherein said pressing mechanism comprises:

a swing arm angularly movable by an actuator;

an attachment arm fixed to an angularly movable end of said swing arm and extending in straddling relation to said takeup shaft; and a movable collar fitted over said takeup shaft for contacting a free end of said attachment arm.

* * * * *